US007296511B2

(12) United States Patent
Koreda et al.

(10) Patent No.: US 7,296,511 B2
(45) Date of Patent: Nov. 20, 2007

(54) RICE HULLING ROLL DRIVING APPARATUS IN RICE HULLER

(75) Inventors: Minoru Koreda, Tokyo (JP); Hiroyuki Kagota, Tokyo (JP); Seiji Yorioka, Tokyo (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 11/414,172

(22) Filed: May 1, 2006

(65) Prior Publication Data

US 2006/0249037 A1 Nov. 9, 2006

(30) Foreign Application Priority Data

May 9, 2005 (JP) ..... 2005-136660

(51) Int. Cl.
*B02B 3/00* (2006.01)

(52) U.S. Cl. ..... 99/488; 99/519; 99/523; 99/524; 99/609; 99/618; 99/620; 99/621

(58) Field of Classification Search ..... 99/486, 99/488, 600–606, 489, 518, 519, 523–525, 99/609–625; 241/7, 11, 14, 37, 42, 49, 257.1; 426/481–483, 518
See application file for complete search history.

(56) References Cited

U.S. PATENT DOCUMENTS 3,885,464 A * 5/1975 Ceballos-Aguilera ..... 99/605
3,960,068 A * 6/1976 Salete ..... 99/606
3,995,542 A * 12/1976 Miecke ..... 99/569
4,194,445 A * 3/1980 Gemsjager ..... 99/618
4,196,224 A * 4/1980 Falk ..... 426/483
4,292,890 A * 10/1981 Salete-Garces ..... 99/603
4,693,903 A * 9/1987 Halwani ..... 426/456
5,048,407 A * 9/1991 Salete-Garces ..... 99/519
5,050,808 A * 9/1991 Satake et al. ..... 241/37
5,209,158 A * 5/1993 Salete ..... 99/519
5,295,629 A * 3/1994 Satake et al. ..... 241/57
5,415,085 A * 5/1995 Thomson ..... 99/574

FOREIGN PATENT DOCUMENTS

JP 03-106452 5/1991
JP 2001-038230 2/2001

* cited by examiner

*Primary Examiner*—Timothy F. Simone
(74) *Attorney, Agent, or Firm*—Staas & Halsey LLP

(57) ABSTRACT

In a rice huller, a first small-diameter pulley and a second large-diameter pulley are attached to a first roll shaft. A first large-diameter pulley and a second small-diameter pulley are attached to a second roll shaft. This configuration makes it possible to switch between a first driving state in which a rice hulling operation is performed by passing and driving a belt between the first small-diameter pulley on the first roll shaft and the first large-diameter pulley on the second roll shaft and a second driving state in which a rice hulling operation is performed by passing and driving a belt between the second large-diameter pulley on the first roll shaft and the second small-diameter pulley on the second roll shaft.

4 Claims, 6 Drawing Sheets

RICE HULLING ROLL DRIVING APPARATUS IN RICE HULLER

BACKGROUND OF THE INVENTION

1. Field of the Invention

The present invention relates to a rice huller for grain, and in particular, to a rice hulling roll driving apparatus in the rice huller.

2. Description of the Related Art

In conventional rice hullers of this kind, a pulley and a driving motor attached to respective roll shafts of a pair of rice hulling rolls (main shaft roll and sub shaft roll) are connected together via an endless belt. These rice hulling rolls, that is, a high- and low-speed side rice hulling rolls, have respective constant rotational frequencies. The high-speed side rice hulling roll is more significantly worn than the low-speed rice hulling roll. A continuous rice hulling operation gradually reduces the outer diameter of the high-speed side rice hulling roll, thereby reducing the difference in peripheral speed between the high- and low-speed side rice hulling rolls. In this case, the high-speed rice hulling roll needs to be replaced with a rice hulling roll having a larger diameter than the low-speed rice hulling roll.

Thus, a rice huller configured as described below has been proposed (see Japanese Patent Application Laid-Open No. 2001-38230). Driving motors having adjustable rotational frequencies are connected to the respective roll shafts of the high- and low-speed side rice hulling rolls. Sensors are provided each of which senses the rotational frequency and outer diameter of the corresponding rice hulling roll. When the difference in peripheral speed between the rice hulling rolls which is determined by the sensors is equal to or smaller than a predetermined value, the rotational frequency of each rice hulling roll is adjusted to maintain a predetermined difference in peripheral speed. This rice huller thus eliminates the need to replace the rice hulling rolls with new ones.

With the driving apparatus in the conventional, common rice huller, the paired rice hulling rolls rotate almost in contact with each other via unhulled rice as material. This causes each rice hulling roll to exert a repulsive force. These repulsive forces act in a direction in which an endless belt, passed between the pulleys attached to the respective roll shafts in a manner such that these pulleys rotate in directions opposite to each other, is tensed. The reaction forces thus offset each other. This phenomenon will be explained with reference to FIG. 6.

A high-speed side rice hulling roll pulley 100 and a low-speed side rice hulling roll pulley 102 are driven by an endless belt 106 diagonally passed between the pulleys, as shown in FIG. 6. The rice hulling pulleys 100 and 102 then rotate at different speeds in directions opposite to each other. This causes each of paired rice hulling rolls 101 and 103 to exert a repulsive force during rice hulling. Specifically, the high-speed side rice hulling roll 101 exerts a force F1 acting in an anti-rotational direction under the effect of the low-speed side rice hulling roll 103. In contrast, the low-speed side rice hulling roll 103 exerts a force F2 acting in a rotational direction under the effect of the high-speed side rice hulling roll 101. The forces F1 and F2 act to tense the endless belt 106, passed between the paired pulleys 100 and 102, to maintain the gap between the rolls. This enables a rice hulling operation to be smoothly performed.

However, the above-mentioned Japanese Patent Application Laid-Open No. 2001-38230 connects the different driving motors to the high- and low-speed side rice hulling rolls.

Thus, avoiding the repulsive forces (F1 and F2) of the rolls, which may be exerted during rice hulling, disadvantageously requires a driving force strong enough to make these repulsive forces negligible.

SUMMARY OF THE INVENTION

An object of the present invention is to provide a driving apparatus in a rice huller which does not require a strong driving force and which enables a rice hulling operation without the need to replace rice hulling rolls with new ones.

In the rice hulling roll driving apparatus in a rice huller according to the present invention, a first roll shaft is provided with a first small-diameter pulley, a second roll shaft is provided with a first large-diameter pulley, and the first small-diameter pulley, the first large-diameter pulley, and a driving pulley for a first motor are connected together via a first endless belt, so that a first and second rice hulling rolls, which constitute paired rice hulling rolls, rotate at different peripheral speeds in directions opposite to each other.

The first roll shaft is provided with a second large-diameter pulley in addition to the first small-diameter pulley, the second roll shaft is provided with a second small-diameter pulley in addition to the first large-diameter pulley, and the second large-diameter pulley, the second small-diameter pulley, and a driving pulley for a second motor are connected together via a second endless belt.

The first small-diameter pulley and the second large-diameter pulley are attached to the first roll shaft so that each of the pulleys may rotate with respect to the first roll shaft, and the first large-diameter pulley and the second small-diameter pulley are attached to the second roll shaft so that each of the pulleys may rotate with respect to the second roll shaft.

Transmission switching means is provided between the first small-diameter pulley and the second large-diameter pulley, which are attached to the first roll shaft, and between the first large-diameter pulley and the second small-diameter pulley, which are attached to the second roll shaft, so as to transmit rotation of the pulleys to the corresponding roll shafts.

And, the transmission switching means comprises a slidable cylinder provided so as to be movable in a direction of each roll shaft, a large diameter portion provided around an outer periphery of the slidable cylinder, a spline shaft formed on the large-diameter portion in order to fit into a boss portion of each of the pulley, a spring that always urges the slidable cylinder toward the pulley attached to the roll shaft at the end thereof, and an air chamber into which compressed air is fed to cause the slidable cylinder to slide against an urging force of the spring.

In the rice hulling roll driving apparatus in the rice huller constructed as described above, the first endless belt may be passed around the driving pulley for the first motor, the first small-diameter pulley, and the first large-diameter pulley, in a manner such that the inner surface of the first endless belt is in contact with the driving pulley and the first small-diameter pulley, while the outer surface of the first endless belt is in contact with the first large-diameter pulley, and the second endless belt may be passed around the driving pulley for the second motor, the second small-diameter pulley, and the second large-diameter pulley, in a manner such that the inner surface of the second endless belt is in contact with the driving pulley and the second small-diameter pulley, while the outer surface of the second endless belt is in contact with the second large-diameter pulley, so that these rice hulling rolls rotate in directions opposite to each other.

With the above configuration in accordance with the present invention, when the high-speed side rice hulling roll is worn, the transmission switching means performs a switching operation so that the current low-speed side rice hulling roll will be used as a high-speed side rice hulling roll. On the other hand, the current high-speed side rice hulling roll will be used as a low-speed side rice hulling roll. This eliminates the need to manually replace the rice hulling rolls with new ones. Further, as an endless belt is passed between the pulley of paired rice hulling rolls so that these pulleys rotates in directions different from each other, as in the case of prior art, inappropriate rice hulling that may result from the repulsive force of the pair of rice hulling rolls does not occur. The present invention therefore provides a driving apparatus of rice hulling rolls in a rice huller which eliminates the need to use a strong driving force otherwise required to avoid the repulsive force of the pair of rolls and which eliminates the need to manually replace the rice hulling rolls with new ones.

BRIEF DESCRIPTION OF THE DRAWINGS

The above-described and other objects and features of the present invention will be apparent from the following description of embodiments read with reference to the accompanying drawings, in which.

DETAILED DESCRIPTION OF THE PREFERRED EMBODIMENTS

Figure 1:
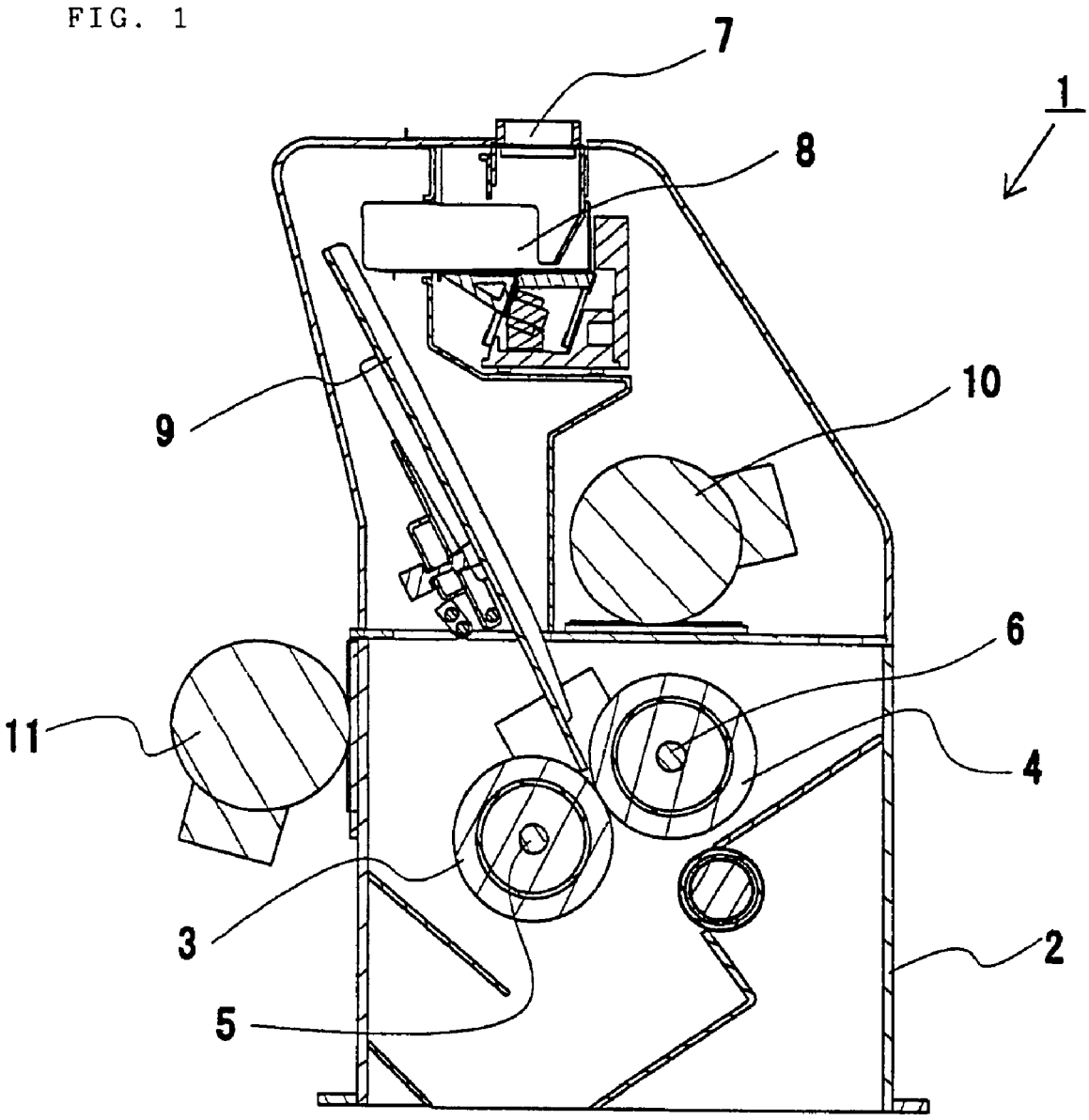
FIG. 1 is a vertically sectional view of a rice huller comprising a rice hulling roll driving apparatus in accordance with the present invention.

FIG. 1 is a vertically sectional view of a rice huller comprising a roll driving apparatus in accordance with the present invention.

A first rice hulling roll 3 and a second rice hulling roll 4 are arranged in a machine frame 2. The first rice hulling roll 3 is rotatably supported around a first roll shaft 5. The second rice hulling roll 4 is rotatably attached to a second roll shaft 6 so as to adjustably approach and leave the first rice hulling roll 3. The first and second rice hulling rolls 3 and 4 rotate at different speeds in directions opposite to each other.

A supply port 7 which supplies grain to be hulled is formed at the top of the machine frame 2. A vibrating feeder 8 is provided immediately below the supply port 7 and can adjust the flow rate of grain. A guide chute 9 is further provided immediately below the vibrating feeder 8 at a predetermined angle of inclination so as to guide grain which has fallen from the vibrating feeder 8 toward the area between the first and second rice hulling rolls 3 and 4. The guide chute 9 has a width (size in vertical direction of sheet of FIG. 1) almost equal to that of the first and second rice hulling rolls 3 and 4. When the straight line joining the first roll shaft 5 with the second roll shaft 6 crosses the trajectory of grain flung out of the guide chute 9 at almost the right angles, the grain being supplied to the first and second rice hulling rolls 3 and 4 is prevented from being flicked away and displaced. This prevents the grain from being crushed.

Figure 2:
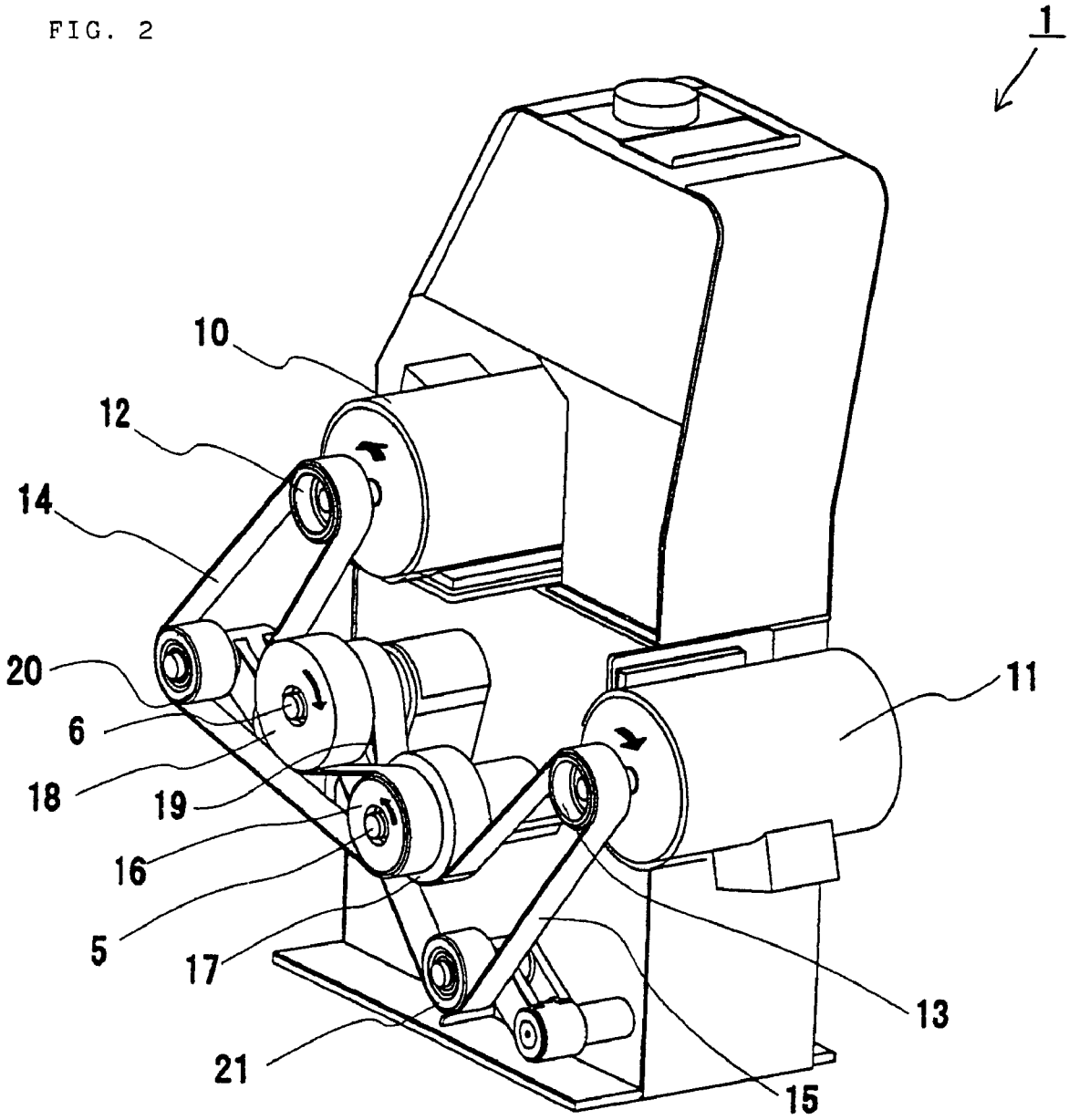
FIG. 2 is a rear perspective view showing an embodiment of a rice hulling roll driving apparatus in the rice huller shown in FIG. 1.

FIG. 2 is a rear perspective view showing an embodiment of a rice hulling driving apparatus in a rice huller in accordance with the present invention.

A first driving motor 10 is provided in the center of the machine frame 2. A second driving motor 11 is provided on a left side surface of the machine frame 2. A first small-diameter pulley 16 is rotatively attached to the first roll shaft 5 on the outer side therof. A first large-diameter pulley 18 is rotatively attached to the second roll shaft 6 on the outer side thereof.

An endless belt 14 is passed around the first small-diameter pulley 16 and first large-diameter pulley 18, a driving pulley 12 for a first driving motor 10, and an idler pulley 20 provided below the first driving motor 10 to form a first driving system.

The endless belt 14 in the first driving system is diagonally passed between the first small-diameter pulleys 16 and the first large-diameter pulleys 18 so that the first small-diameter pulleys 16 and the first large-diameter pulleys 18 rotate in directions opposite to each other, with the inner surface of the endless belt 14 in contact with first small-diameter pulley 16 and with the outer surface thereof in contact with the first large-diameter pulley 18. This endless belt 14 is driven so as to rotate leftward as viewed from the rear of the rice huller 1.

A second large-diameter pulley 17 is further rotatably attached to the first roll shaft 5 in proximity to the first small-diameter pulley 16 between the first small-diameter pulley 16 and the first rice hulling roll 3. A second small-diameter pulley 19 is further rotatably attached to the second roll shaft 6 in proximity to the first large-diameter pulley 18 between the first large-diameter pulley 18 and the second rice hulling roll 4. An endless belt 15 is passed around the second large-diameter pulley 17, the second small-diameter pulley 19, a driving pulley 13 for a second driving motor 11, and an idler pulley 21 to form a second driving system.

The endless belt 15 in the second driving system is diagonally passed between the second large-diameter pulleys 17 and the second small-diameter pulleys 19 so that the second large-diameter pulleys 17 and the second small-diameter pulleys 19 rotate in directions opposite to each other, with the outer surface of the endless belt 15 in contact with the second large-diameter pulley 17 and with the inner surface thereof in contact with the second small-diameter pulley 19.

Figure 3:
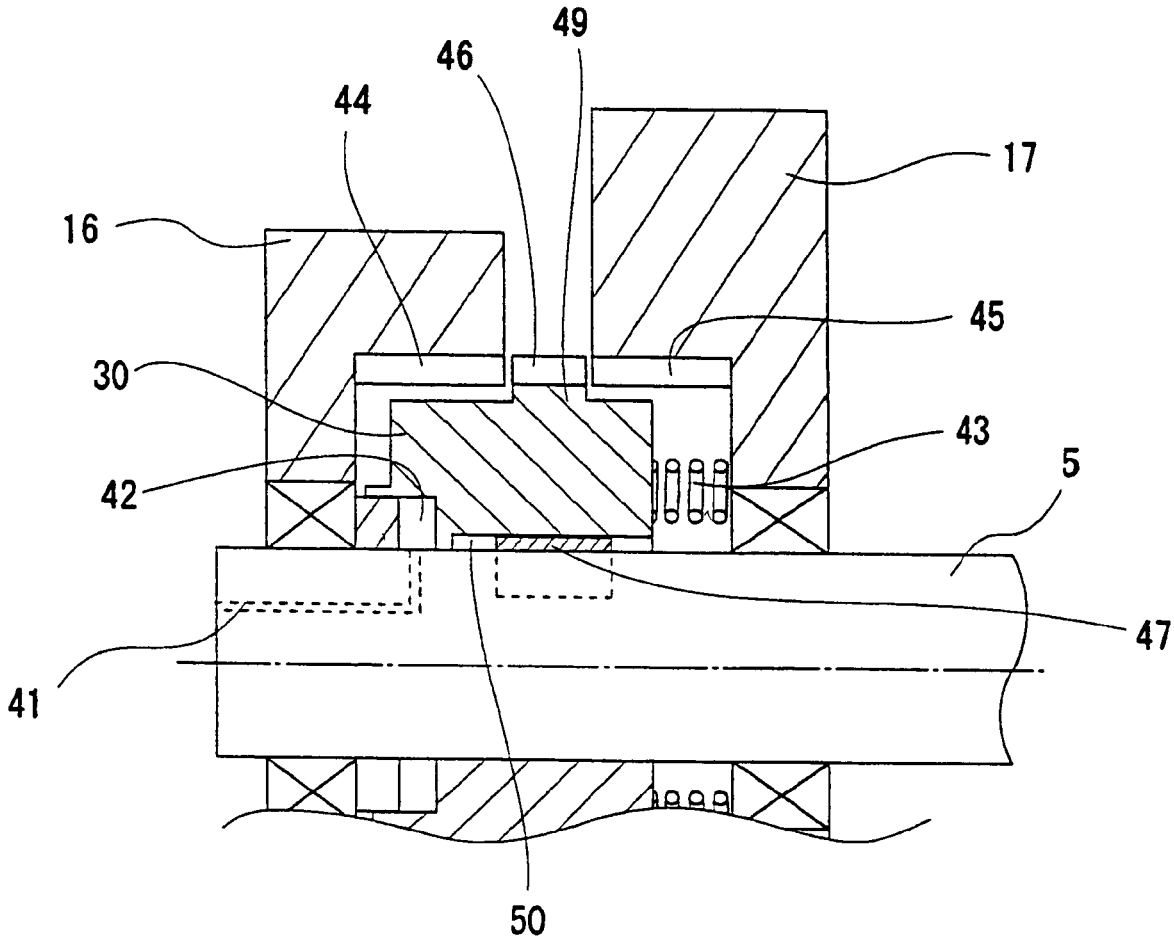
FIG. 3 is a partly enlarged sectional view showing a transmission switching means in the rice hulling roll driving apparatus shown in FIG. 2.
Figure 4A:
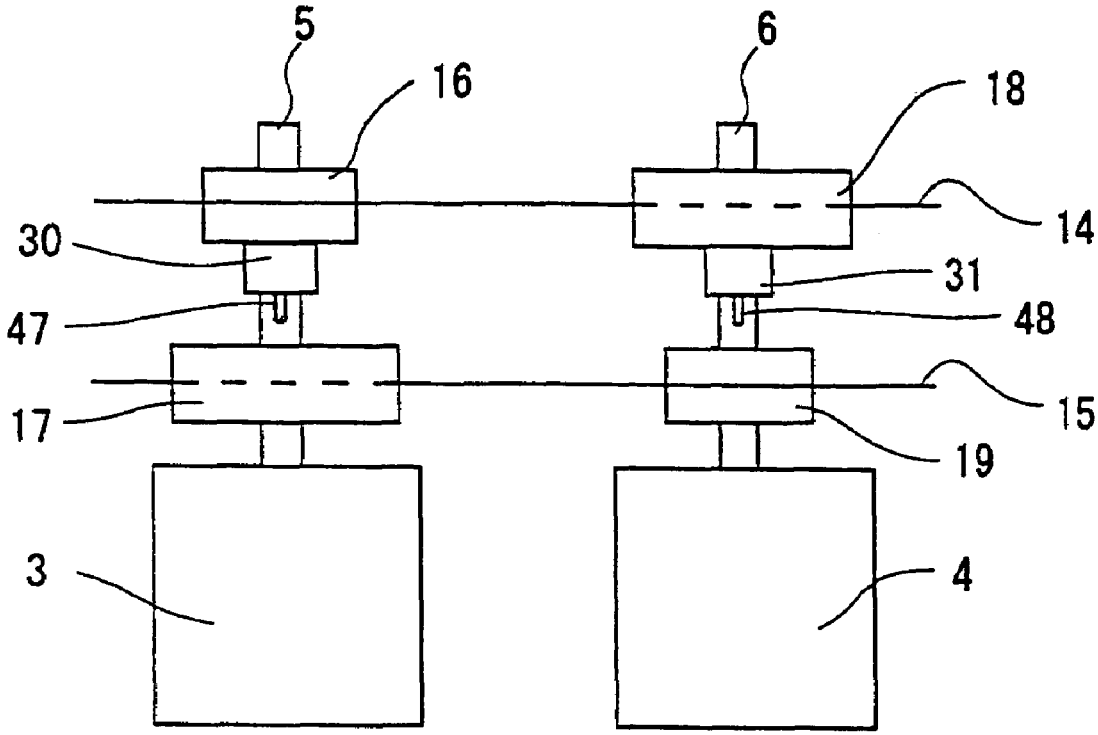
FIGS. 4A and 4B are schematic diagrams showing operations of the transmission switching means shown in FIG. 3.
Figure 4B:
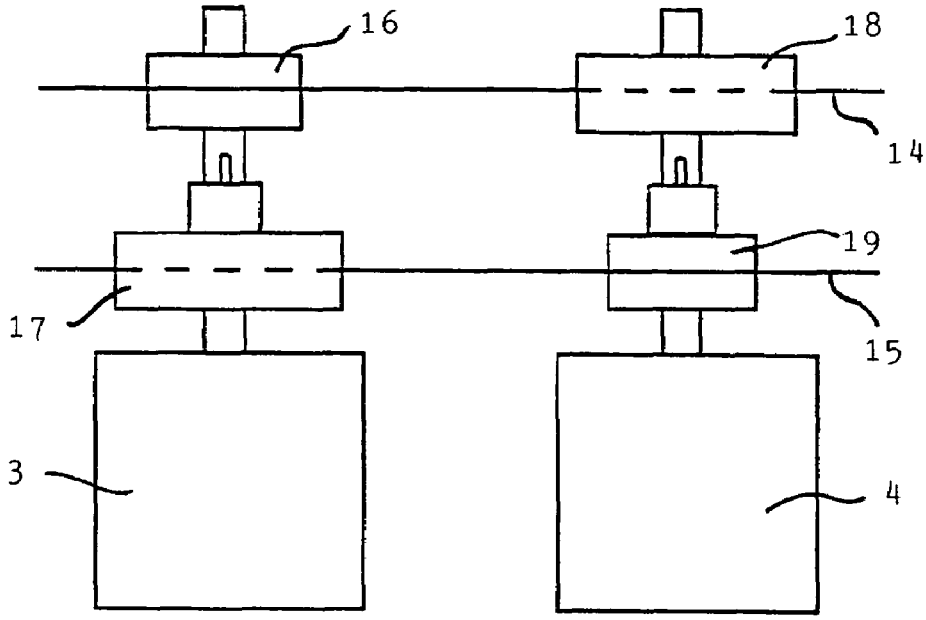

FIG. 3 is a partly enlarged sectional view showing transmission switching means in accordance with the present embodiment. FIGS. 4A and 4B are schematic diagrams showing the procedure of operations of the transmission switching means.

The transmission switching means is provided for each of the first and second roll shafts 5 and 6. The transmission switching means on the side of the first roll shaft 5 is mounted so as to lie between the first small-diameter pulley 16 and second large-diameter pulley 17 of the first roll shaft 5 and touch internally with either of the pulleys 16 and 17. Specifically, the top of a key 47 provided on the first roll shaft 5 is fitted into a key groove 50 in a slidable cylinder 30. The slidable cylinder 30 can then slide along the key 47 in the axial direction of the first roll shaft 5.

The slidable cylinder 30 is provided with a larger diameter portion 49 around its outer periphery. A plurality of key grooves are formed in the larger diameter portion 49 to constitute a spline shaft 46. On the other hand, a plurality of key grooves are formed in boss portions of the first small-diameter pulley 16 and second large-diameter pulley 17 to constitute spline bosses 44 and 45. The spline shaft 46 of the slidable cylinder 30 is selectively connected (spline coupling) to either the spline boss 44 of the first small-diameter pulley 16 or the spline boss 45 of the second large-diameter pulley 17 to transmit power to the selected pulley.

Like the transmission switching means on the side of the first roll shaft 5, the transmission switching means on the side of the second roll shaft 6 is mounted so as to lie between the first large-diameter pulley 18 and second small-diameter pulley 19 of the second roll shaft 6 and touch internally with either of the pulleys 18 and 19. Specifically, the top of a key 48 provided on the second roll shaft 6 is fitted into a key groove (not shown) in a slidable cylinder 31. The slidable cylinder 31 can then slide along the key 48 in the axial direction of the second roll shaft 6. The slidable cylinder 31 is provided with a larger diameter portion (not shown) around its outer periphery. A plurality of key grooves are formed in the larger diameter portion to constitute a spline shaft (not shown). On the other hand, a plurality of key grooves are formed in boss portions of the first large-diameter pulley 18 and second small-diameter pulley 19 to constitute spline bosses (not shown). The spline shaft of the slidable cylinder 31 is selectively connected to either the spline boss of the first large-diameter pulley 18 or the spline boss of the second small-diameter pulley 19 to transmit power to the selected pulley.

The transmission switching means on the side of the first roll shaft 5 has the same configuration as that of the transmission switching means on the side of the second roll shaft 6. Thus, only the transmission switching means for the first roll shaft 5 will be described.

A spring 43 is interposed between the slidable cylinder 30 and the second large-diameter pulley 17. The spring 43 always urges the slidable cylinder 30 toward the first small-diameter pulley 16 to engage the spline shaft 46 with the spline boss 44. This allows the rotative driving force of the first small-diameter pulley 16 to be transmitted to the first roll shaft 5 via the slidable cylinder 30 (first system driving state; see FIG. 4A).

An air chamber 42 is provided in a gap defined by the slidable cylinder 30 and the first small-diameter pulley 16. An air pipe 41 is formed in the roll shaft 5 to supply and discharge air to and from the air chamber 42. Compressed air is fed to the air chamber 42 via the air pipe 41 to expand the air chamber 42. This causes the slidable cylinder 30 to slide along the key 47 toward the second large-diameter pulley 17 against the urging force of the spring 43. Then, the spline shaft 46 engages with the spline boss 45 to transmit a driving force from the second large-diameter pulley 17 to the roll shaft 5 via the slidable cylinder 30 (second system driving state; see FIG. 4B). The transmission switching means on the side of the first roll shaft 5 and the transmission switching means on the side of the second roll shaft 6 simultaneously perform a switching operation.

Figure 5:
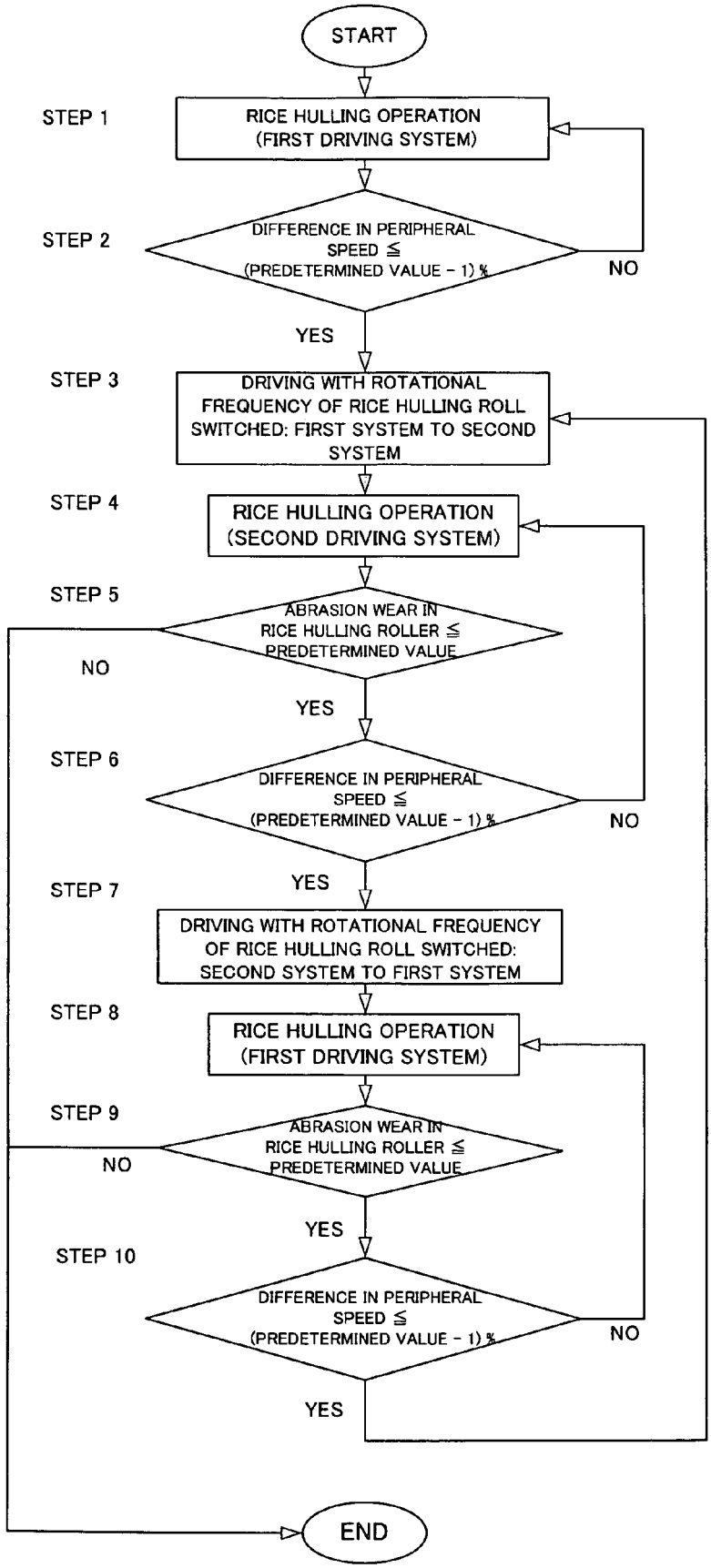
FIG. 5 is a flowchart showing the procedure of operations of the transmission switching means shown in FIG. 3.
Figure 6:
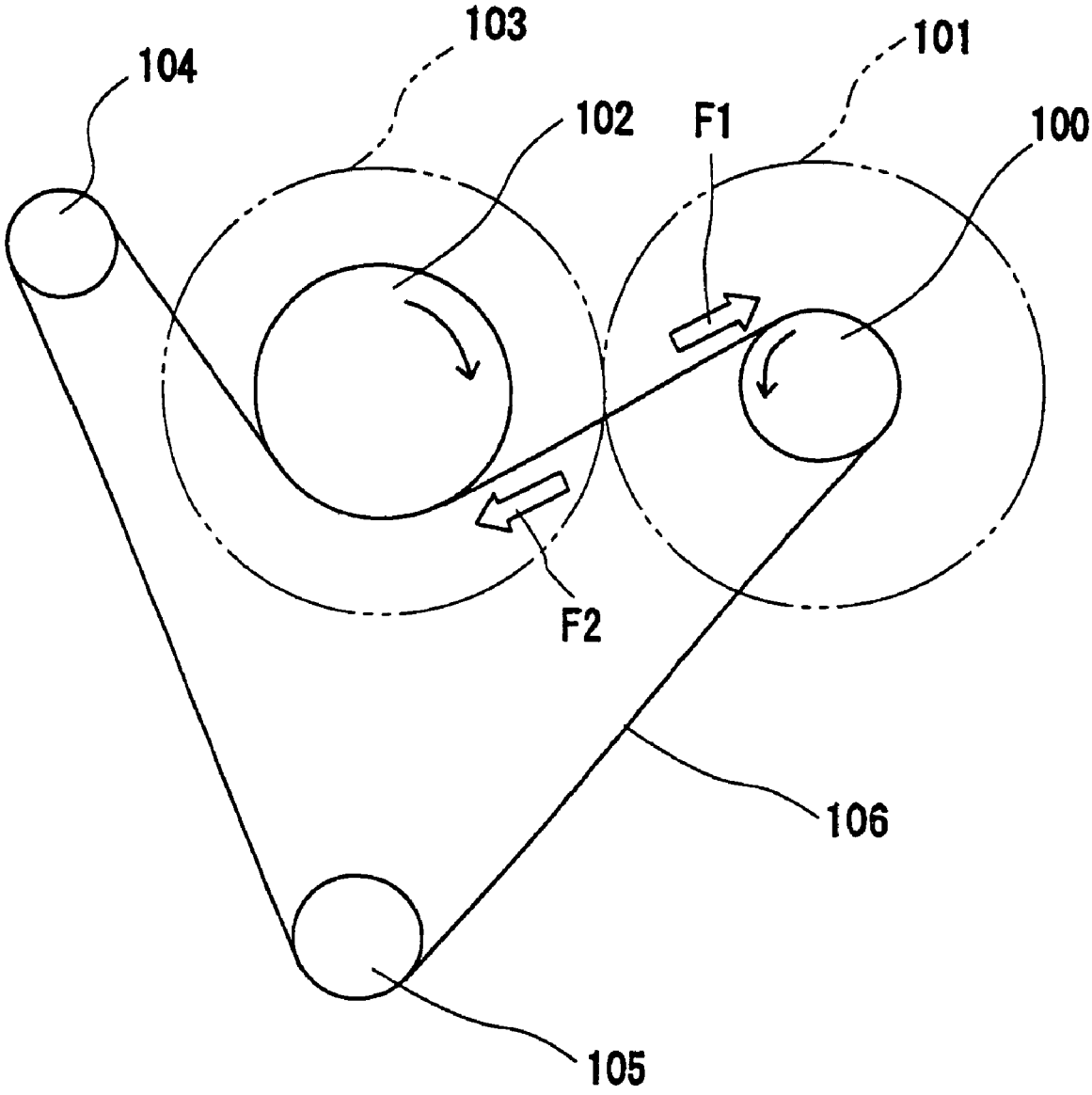
FIG. 6 is a schematic diagram showing a driving apparatus in a conventional rice huller.

With reference to the flowchart in FIG. 5, description will be given of the procedure of operations of the transmission switching means shown in FIGS. 3, 4A, and 4B.

The rice huller 1 is powered on to start driving the first driving motor 10. The transmission switching means is brought into a first system driving state. Specifically, the driving force of the first driving motor 10 is transmitted to the first small-diameter pulley 16 and first large-diameter pulley 18 via the endless belt 14 in the first driving system. The first rice hulling roll 3 rotates at a high speed, while the second rice hulling roll 4 rotates at a low speed. These rice hulling rolls 3, 4 rotate in directions opposite to each other.

Subsequently, driving of the vibrating feeder 8 is started to drop grain (unhulled rice) fed from the supply port 7, onto the guide chute 9. The unhulled rice having fallen on the guide chute 9 slides down in the form of a thin layer and is then loaded in between the first and second rice hulling rolls 3 and 4. The loaded unhulled rice is hulled owing to the difference in peripheral speed between the first rice hulling roll 3, rotating at the high speed, and the second rice hulling roll 4, rotating at the low speed. This allows the hulls to be peeled off from the unhulled rice (step 1).

The continuous rice hulling operation in the first system driving state gradually wears the first and second rice hulling rolls 3 and 4. The first rice hulling roll 3, rotating at the high speed, has a larger accumulative area over which it contacts the unhulled rice than the second rice hulling roll 4, rotating at the low speed. The first rice hulling roll 3 is thus worn earlier. This reduces the outer diameter of the first rice hulling roll 3, thereby reducing the difference in peripheral speed between the first and second rice hulling rolls 3 and 4. If the value of the difference in peripheral speed is smaller than a predetermined value by, for example, 1% (or the value of the difference is 22% or less if the predetermined value is 23%) (step 2), the transmission switching means is brought into a second system driving state (step 3). Specifically, driving of the vibrating feeder 8 and the first system driving motor 10 are stopped, and the second system driving motor 11 is driven.

The driving force of the second system driving motor 11 is transmitted to the second large-diameter pulley 17 and second small-diameter pulley 19 via the endless belt 15 in the second driving system. The first rice hulling roll 3 rotates at a low speed, while the second rice hulling roll 4 rotates at a high speed. Driving of the vibrating feeder 8 is started again to resume a rice hulling operation (step 4). During the rice hulling operation in the first system driving state, the second rice hulling roll 4 has a larger diameter than the first rice hulling roll 3. This maintains the difference in peripheral speed at at least the predetermined value, resulting in a continuous rice hulling operation.

The transmission switching means switches the second rice hulling roll 4 from a low-speed rotation side to a high-speed rotation side. The second rice hulling roll 4 is thus worn earlier than the first rice hulling roll 3. This gradually reduces the outer diameter of the second rice hulling roll 4, thereby reducing the difference in peripheral speed between the first and second rice hulling rolls 3 and 4. If the value of the difference in peripheral speed is smaller than the predetermined value by, for example, 1% (or the value of the difference is 22% or less if the predetermined value is 23%) (step 6), the transmission switching means is brought into the first system driving state again (step 7). Subsequently, every time the value of the difference in peripheral speed becomes smaller than the predetermined one by, for example, 1%, the transmission switching means performs a switching operation (steps 6 and 10). The rice hulling operation is continued by alternately switching the rice hulling rolls 3 and 4 to the high-speed rotation side, which is more significantly worn.

If the amounts of wear in the first and second rice hulling rolls 3 and 4 reach a predetermined value (steps 5 and 9), driving of the vibrating feeder 8 is stopped to stop driving the first or second driving motor 10 or 12 to end the operation. The first and second rice hulling rolls 3 and 4 are replaced with new ones. The operation is then resumed.

Repetition of a switching operation of the transmission switching means as described above enables the rice hulling process to be continued without the need to replace the rice hulling rolls until the predetermined amount of friction is reached. A rice huller with a suitable difference in peripheral speed can thus be provided without the need for a strong driving force.

The invention claimed is:

1. A rice hulling roll driving apparatus in a rice huller wherein, a first roll shaft is provided with a first small-diameter pulley, a second roll shaft is provided with a first large-diameter pulley, and the first small-diameter pulley, the first large-diameter pulley, and a driving pulley for a first motor are connected together by a first endless belt, so that a first and second rice hulling rolls, which constitute paired rice hulling rolls, rotate at different peripheral speeds in directions opposite to each other;

the first roll shaft is provided with a second large-diameter pulley in addition to said first small-diameter pulley, the second roll shaft is provided with a second small-diameter pulley in addition to said first large-diameter pulley, and the second large-diameter pulley, the second small-diameter pulley, and a driving pulley for a second motor are connected together by a second endless belt;

the first small-diameter pulley and the second large-diameter pulley are attached to the first roll shaft so that each of the pulleys may rotate with respect to the first roll shaft, and the first large-diameter pulley and the second small-diameter pulley are attached to the second roll shaft so that each of the pulleys may rotate with respect to the second roll shaft;

transmission switching means is provided between the first small-diameter pulley and the second large-diameter pulley, which are attached to the first roll shaft, and between the first large-diameter pulley and the second small-diameter pulley, which are attached to the second roll shaft, so as to transmit rotation of the pulleys to the corresponding roll shafts; and said transmission switching means comprises a slidable cylinder provided so as to be movable in a direction of each roll shaft, a large diameter portion provided around an outer periphery of the slidable cylinder, a spline shaft formed on the large-diameter portion in order to fit into a boss portion of each of the pulley, a spring that always urges the slidable cylinder toward the pulley attached to the roll shaft at the end thereof, and an air chamber into which compressed air is fed to cause the slidable cylinder to slide against an urging force of the spring.

2. The rice hulling roll driving apparatus in the rice huller according to claim 1, wherein the first endless belt is passed around the driving pulley for the first motor, the first small-diameter pulley, and the first large-diameter pulley, in a manner such that the inner surface of the first endless belt is in contact with the driving pulley and the first small-diameter pulley, while the outer surface of the first endless belt is in contact with the first large-diameter pulley, and the second endless belt is passed around the driving pulley for the second motor, the second small-diameter pulley, and the second large-diameter pulley, in a manner such that the inner surface of the second endless belt is in contact with the driving pulley and the second small-diameter pulley, while the outer surface of the second endless belt is in contact with the second large-diameter pulley, so that these rice hulling rolls rotate in directions opposite to each other.

3. The rice hulling roll driving apparatus in the rice huller according to claim 1, wherein the transmission switching means performs a switching operation every predetermined time.

4. The rice hulling roll driving apparatus in the rice huller according to claim 1, wherein the transmission switching means performs a switching operation if a value for a difference in peripheral speed between the pair of rice hulling rolls is smaller than a predetermined value.

* * * * *